US006447031B1

(12) United States Patent
O'Hanlon

(10) Patent No.: US 6,447,031 B1
(45) Date of Patent: Sep. 10, 2002

(54) LEVER HANDLE FOR ATTACHMENT TO A ROUND DOOR LOCK HANDLE

(76) Inventor: Edward O'Hanlon, 3268 E. 26th St., Tucson, AZ (US) 85713

( * ) Notice: Subject to any disclaimer, the term of this patent is extended or adjusted under 35 U.S.C. 154(b) by 12 days.

(21) Appl. No.: 09/636,715

(22) Filed: Aug. 11, 2000

(51) Int. Cl.[7] ..... E05B 3/00

(52) U.S. Cl. ..... 292/348; 292/347; 292/DIG. 2; 16/422; 16/413

(58) Field of Search ..... 292/347, 348–350, 292/DIG. 2; 16/422, 413

(56) References Cited

U.S. PATENT DOCUMENTS 2,020,590 A * 11/1935 Swain ..... 292/347
2,463,195 A * 3/1949 Mungan ..... 70/416
2,756,088 A * 7/1956 Sutter ..... 292/347
2,942,909 A * 6/1960 Chase ..... 292/347
3,549,184 A * 12/1970 Anderson ..... 292/195
3,575,453 A * 4/1971 Hohl ..... 292/336.3
3,827,739 A * 8/1974 Overholser ..... 292/347
3,960,396 A * 6/1976 Miyahara ..... 292/347
4,018,465 A * 4/1977 Ramler ..... 292/336.3
4,223,931 A * 9/1980 Neary ..... 292/347
4,285,536 A * 8/1981 McCoy et al. ..... 292/336.3
4,397,489 A * 8/1983 Lind ..... 292/347
4,504,087 A * 3/1985 Pennington ..... 292/347
4,648,643 A * 3/1987 Bettger ..... 292/347
4,783,883 A * 11/1988 Szalay ..... 16/114 R
4,877,277 A * 10/1989 Leopoldi ..... 292/347
4,913,479 A * 4/1990 Allison ..... 292/347
4,971,375 A * 11/1990 Grecco ..... 292/347
5,231,731 A * 8/1993 Jones, Jr. ..... 16/114 R
5,288,116 A * 2/1994 Donofrio ..... 292/336.3
5,664,287 A * 9/1997 Sendelbach ..... 16/114 R
5,725,264 A * 3/1998 Villarreal ..... 292/347
5,787,744 A * 8/1998 Berger et al. ..... 70/422

* cited by examiner

*Primary Examiner*—Anthony Knight
*Assistant Examiner*—John B. Walsh

(57) ABSTRACT

A device for attaching to a door knob which comprises a metal strip which has an arced width which clamps on to two peripheries of the door knob and which arced surface is also curved to encircle and contact 90% of the door knob diameter and which curved section has two free ends which are pulled into a tubular section by means of a hook bolt and end nut, the whole being assembled on to the door knob without the use of any tools or other attaching means and which complete device can be readily attached and removed for further installation on other door knobs as required.

2 Claims, 4 Drawing Sheets

FIG. 1
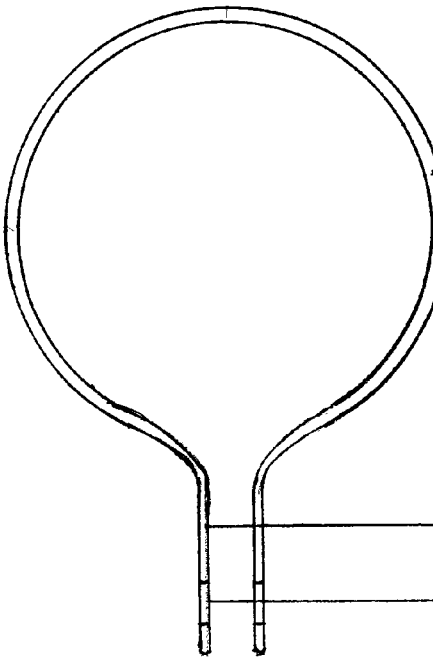
FIG. 2
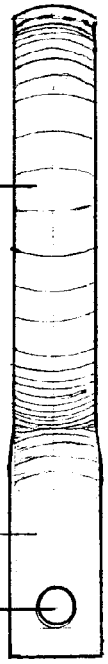
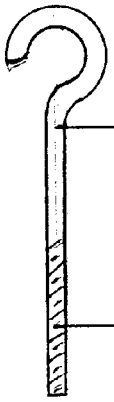
FIG. 3
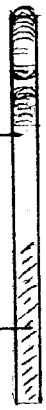
FIG. 4

FIG. 9
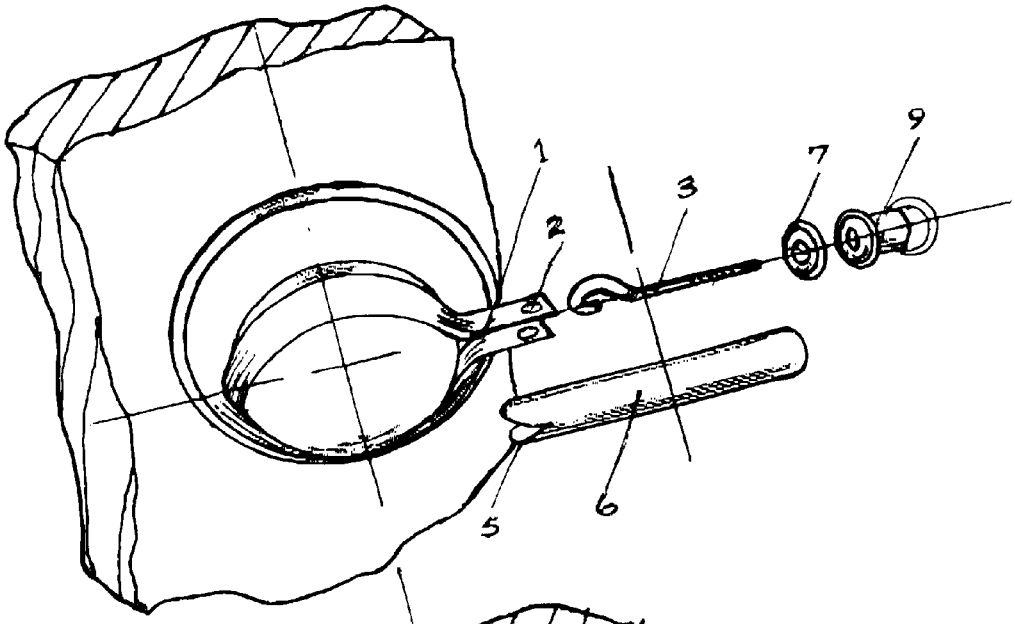
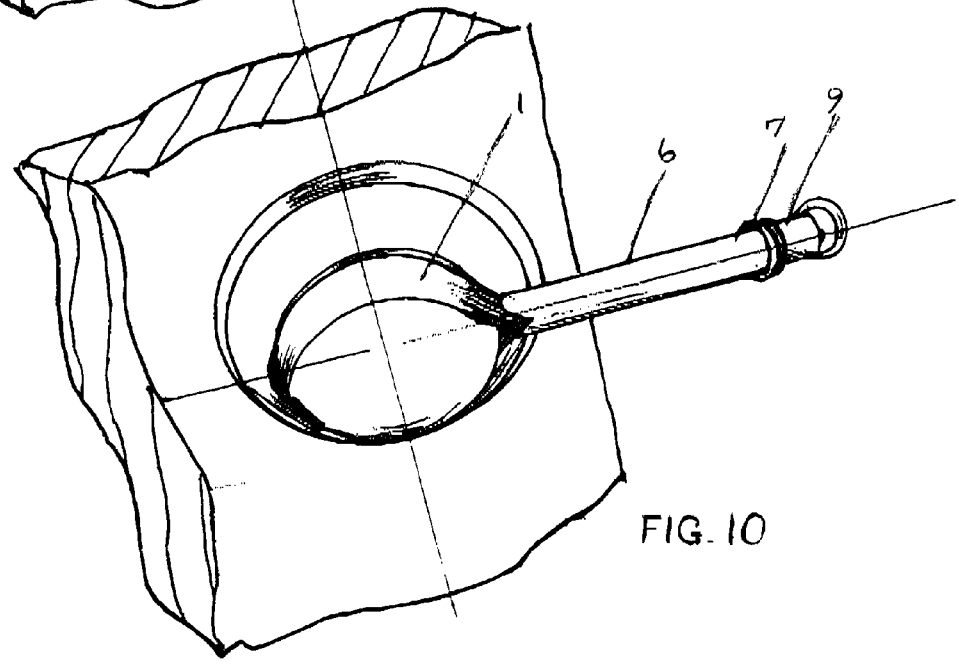
FIG. 10

LEVER HANDLE FOR ATTACHMENT TO A ROUND DOOR LOCK HANDLE

BACKGROUND OF THE INVENTION

Heretofore persons with limited manual dexterity due to some illness find great difficulty in gripping, turning and pulling such objects as standard round door lock handles as found in most homes. The only means of circumventing this problem was to replace the low cost round handles with expensive cast lever handles which require that the handle need only be depressed, thus obviating the grip and turn requirement of the round handles. This operation of replacing the round handles with lever handles had to be repeated each time the person moved to new home. A lever handle attachment made in accordance with this invention provides a fast and low cost method of converting a round door handle into a lever handle in such a manner that the lever handle can be readily removed and relocated in the new home.

SUMMARY OF THE INVENTION

This lever handle consists of a metal strip whose width and length are formed such that the width is formed into an arc and its length is formed into a circular shape in such a manner that two free and equal ends are obtained which are diametrically opposite the center point of the metal strip. These two free ends are drilled such that the hook section of a hook bolt can fit readily through these two drilled holes. A tubular section 6f sufficient internal diameter to accomodate the free ends of the metal strip width is slid over the hook bolt and metal strip free ends combination such that one end of this tubular section bears upon the free ends of the metal strip and the hook bolt thread appears through the opposite end of the tubular section.

A bevelled washer of suffice diameter to cover the end of the tubular section is slid over the protruding end of the hook bolt and then an end nut is threaded in to the hook bolt.

When the large circular section of the said metal strip is placed over the largest diameter of the existing door handle and the end screw on the end of the hook bolt is tightened the free ends of the metal strip are pulled into the tubular Section in such a manner that the circular section of the metal strip is decreased in diameter and is thus tightened on to the door handle. The end screw is tightened further until the circular section of the metal strip is held rigidly on to the door handle. In this manner the ends of the arc formed on the width of the metal strip cut into the door knob diameter such that the attached lever handle cannot me moved in any plane with respect to the door knob.

An object of this invention it the provision of lever handle consisting of a metal strip shaped both in width and and length such that when this metal shape is placed over the largest diameter of an existing door knob and its free ends are pulled into a tubular section by means of a hook bolt and nut assembly working in conjunction with a bevelled washer a lever handle assembly is formed which effectively converts the round door knob into a lever handle.

The above stated and other objects and advantages of the invention will become apparent from the following description when taken with the accompanying drawings. I will be understood, however, that the drawings are for purposes of illustration and are not to be construed as defining the scope or limits of the invention, references being had for the latter pupose to the claims appended hereto.

BRIEF DESCRIPTION OF THE DRAWINGS

In the drawings wherein like reference characters denote like parts in the several views.

FIG. 1. is a view of the circular shape and free ends of the metal strip.

FIG. 2. is a side view of the metal strip showing the arced width of metal and also holes in the free ends.

FIGS. 3 and 4. are front an side views of the hook bolt.

FIG. 9 is an exploded view of the lever handle being attached to a door knob.

FIG. 10 is a complete view of the lever handle after being attached to a door knob.

DESCRIPTION OF THE PREFERRED EMBODIMENT

Figure 5:
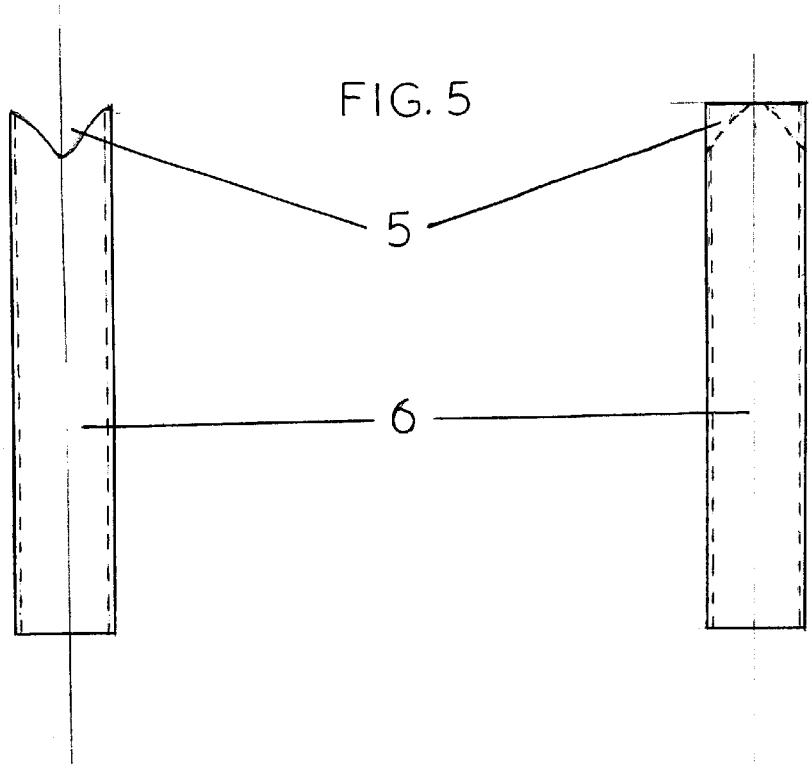
FIG. 5 is a front and side view of the tubular section.
Figure 6:
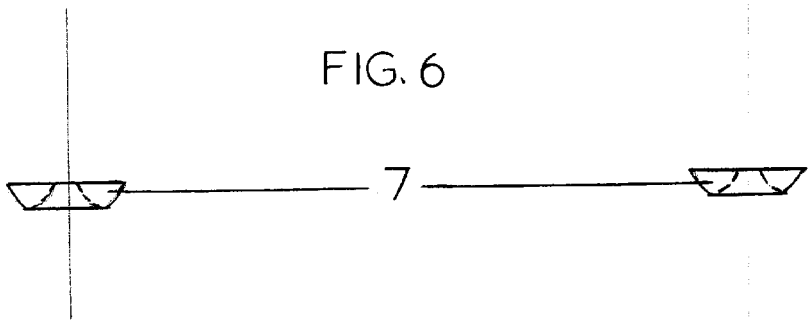
FIG. 6 is a view of the bevelled washer.
Figure 7:
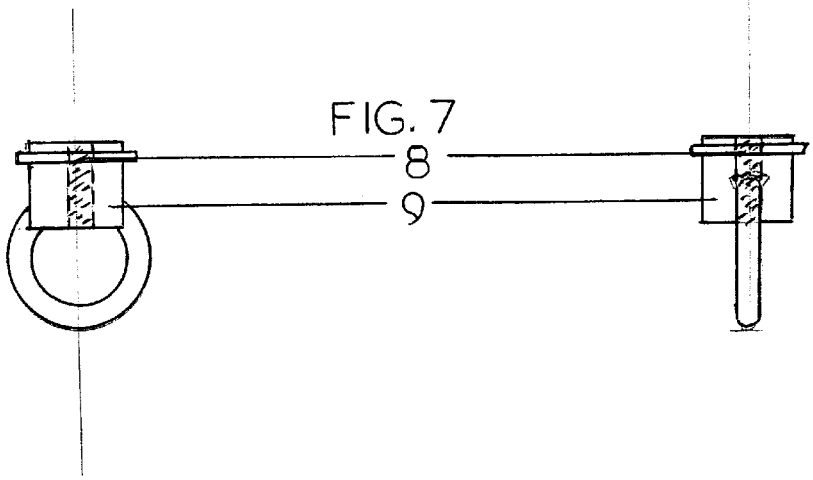
FIG. 7 is view of the end nut
Figure 8:
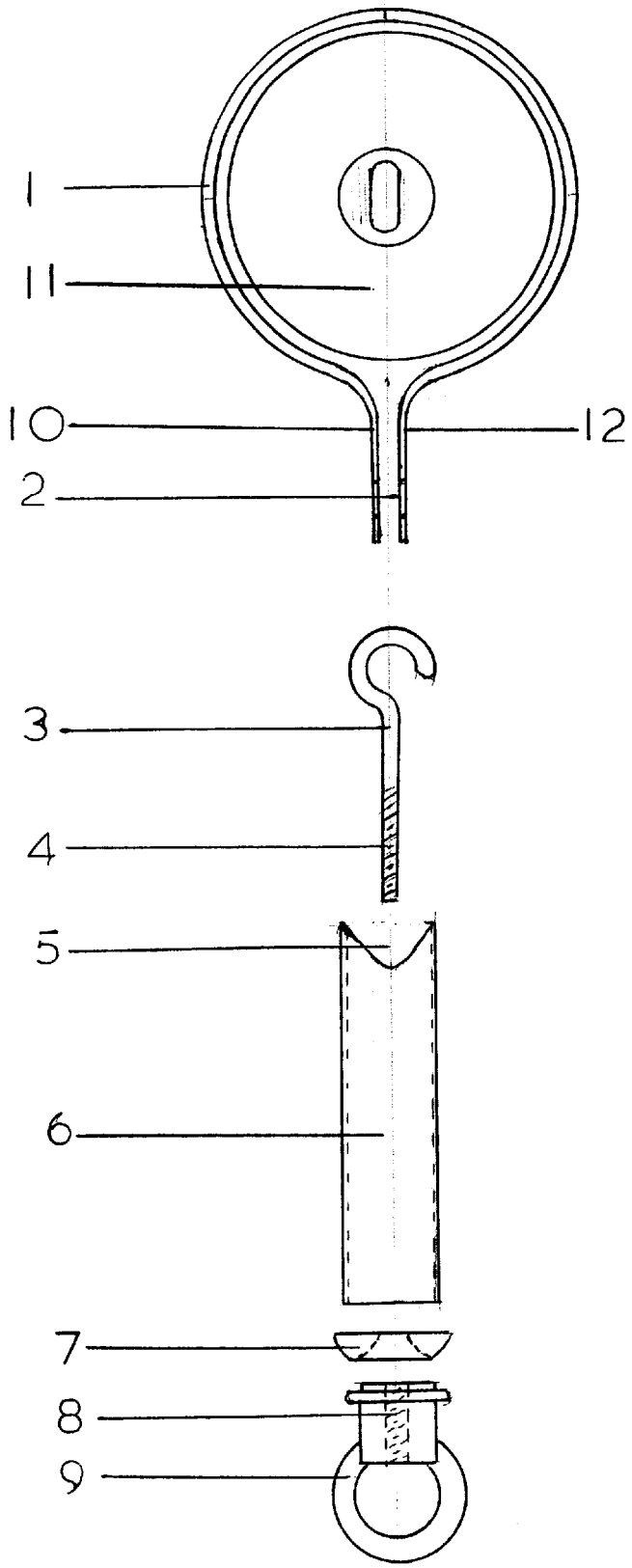
FIG. 8 is an exploded view of all of the components comprising the lever handle.

FIGS. 1 through 7 show view of the various components comprising the lever handle assembly. FIG. 8 shows an exploded view of the lever handle in which the components are shown in the order in which they are assembled. The circular shaped metal section (1) is placed over the round handle of the existing door lock (11). When thus placed the two free ends (10) and (12) protrude out from the door knob (11) towards the center of the door such that when these said free ends (10) and (12) are pressed together manually the the drilled holes (2) are brought into line and the hook section of the hook bolt (3) can be inserted into the said drilled holes (2).

The tubular section (6) slides over hook bolt (3) and thence over the free ends (10) and (12) such that the V slot (5) exteme ends bears upon free ends (10) and (12) such that the 'V' slot (5) extreme ends bear upon the flat surfaces of the said free ends (10) and (12) and the threaded section (4) of hook bolt (3) appears through the opposite end of the tubular section (6).

The bevelled washer (7) slides over the exposed thread (4) of hook bolt (3) such that it seals the end of the tubular section (6) and then the end nut (9) is screwed on to the hook bolt (3) thread (4) via thread (8) within the end nut (9).

Upon tightening the end nut (9) the hook bolt (3) is pulled further into the tubular section (6) which action, in turn, pulls the free ends (10) and (12) also further into the tubular section (6). This action causes the diameter of the circular section (1) to decrease thus causing the said circular section (1) to tighten upon the aforesaid door knob (11).

Continued turning of end nut (9) causes the arced surface width of the circular section to bite into the surface diameter of the door knob (11) as the diameter of the circular section (1) is further reduced by the turning action on end nut (9). The end nut (9) is hand turned until it cannot be turned any more. At this point the lever handle cannot be moved, in any plane, with respect to door knob (11) and the conversion of the round door door handle (11) into a lever handle is complete.

Because the diameter of the circular section (1) is decreased by the action of turning end nut (9) the lever handle fits any diameter door knob. This reduction in the diameter of the circular section (1) causes a bond to be formed between the arced width of the circular shape (1) and 90% of the outer periphery of the round knob (11) thus preventing any movement between these two bodies.

What is claimed:

1. A lever handle which is attached to an existing round door lock handle wherein a metal strip formed into an arc on its width and into a circular shape in its length and of sufficient length to produce two free ends which extend out from the circular shape in such a manner that these said free ends are pulled into a tubular section, which section forms a lever handle, by means of a hook bolt, bevelled washer and end nut assembly such that the said circular shape reduces in diameter as a result of this pulling force thus forming a bond between the arced width of the metal strip and and the said round door handle to which it is attached; the improvement wherein this said attached lever handle assembly converts the round door handle into a lever handle thus removing the grasp, twist and pull requirement of the standard round door knob.

2. The invention as recited in claim 1 wherein a hook bolt is inserted into holes drilled into the said free ends of the said arced and circular shape such that these said free ends are used to reduce the diameter of the said circular shape by being pulled into the aforementioned tubular section when a force is applied to the end of the said hook bolt.

* * * * *